US009997840B2

(12) United States Patent
Seong et al.

(10) Patent No.: US 9,997,840 B2
(45) Date of Patent: Jun. 12, 2018

(54) TRANSMISSION TYPE ANTENNA

(71) Applicant: EMW CO., LTD., Incheon (KR)

(72) Inventors: Won Mo Seong, Gyeonggi-do (KR); Gi Ho Kim, Gyeonggi-do (KR); Seung Up Seo, Seoul (KR)

(73) Assignee: EMW CO., LTD., Incheon (KR)

( * ) Notice: Subject to any disclaimer, the term of this patent is extended or adjusted under 35 U.S.C. 154(b) by 23 days.

(21) Appl. No.: 15/111,209

(22) PCT Filed: Jan. 12, 2015

(86) PCT No.: PCT/KR2015/000274

§ 371 (c)(1),
(2) Date: Jul. 13, 2016

(87) PCT Pub. No.: WO2015/105388

PCT Pub. Date: Jul. 16, 2015

(65) Prior Publication Data

US 2016/0336659 A1 Nov. 17, 2016

(30) Foreign Application Priority Data

Jan. 13, 2014 (KR) ..... 10-2014-0004116

(51) Int. Cl.
*H01Q 19/12* (2006.01)
*H01Q 19/13* (2006.01)
*H01Q 15/00* (2006.01)

(52) U.S. Cl.
CPC ..... *H01Q 19/13* (2013.01); *H01Q 15/0086* (2013.01)

(58) Field of Classification Search
CPC ..... H01Q 19/12; H01Q 19/13; H01Q 19/17; H01Q 1/46; H01Q 3/08
USPC ..... 343/840, 795, 905, 872, 766, 757
See application file for complete search history.

(56) References Cited

U.S. PATENT DOCUMENTS

2004/0246194 A1* 12/2004 Usami ..... H01Q 1/28 343/872
2005/0057432 A1* 3/2005 Anderson ..... H01Q 1/366 343/909
2012/0001816 A1* 1/2012 Blaney ..... H01Q 25/00 343/765

FOREIGN PATENT DOCUMENTS

KR 10-1992-0010206 B1 11/1992
KR 10-2001-0031359 A 4/2001
KR 10-2004-0047894 A 6/2004

OTHER PUBLICATIONS

International Search Report for PCT/KR2015/000274.

* cited by examiner

*Primary Examiner* — Dameon E Levi
*Assistant Examiner* — Collin Dawkins
(74) *Attorney, Agent, or Firm* — The PL Law Group, PLLC

(57) ABSTRACT

A transmission type antenna includes a transmission type structure for transmitting and radiating an incident radio wave, a power feeding body for radiating the radio wave to the transmission type structure or receiving the incident radio wave, a drive shaft for moving or tilting the power feeding body, a body for providing a moving path of the power feeding body through the drive shaft, and a control unit, connected through the drive shaft to the power feeding body, for controlling the movement and tilt of the drive shaft to thereby determine the tilling direction of the power feeding body.

9 Claims, 4 Drawing Sheets

TRANSMISSION TYPE ANTENNA

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2015/000274, filed on Jan. 12, 2015, which claims priority to the benefit of Korean Patent Application No. 10-2014-0004116 filed in the Korean Intellectual Property Office on Jan. 13, 2014, the entire contents of which are incorporated herein by reference.

TECHNICAL FIELD

The present invention relates to an antenna, and more specifically, to a transmission type antenna which is able to determine a radiating position of a power feeding body by moving the power feeding body.

BACKGROUND ART

As interest and research regarding satellite communications has increased in recent years, a demand for a reflector antenna using a GHz band has also increased. Since a reflector antenna has a simple structure that can easily be installed and is a high gain antenna, it is appropriate for satellite communications.

A parabola antenna is a representative reflector antenna. A parabola antenna is an antenna using a parabola-shaped reflector, which uses a principal in which a radio wave, emitted towards a reflector of which cross section describes a parabola, is reflected and converges on a focus, or the radio wave converges in one direction and is strongly radiated.

Meanwhile, a radiating direction is determined by a shape and a facing direction of a curved surface which reflects the radio wave.

SUMMARY

The embodiments of the present invention are directed to providing a transmission type antenna having a transmission type structure in which a position of a power feeding body is controllable.

Further, the embodiments of the present invention are directed to providing a transmission type antenna which is able to determine a radiating position of a power feeding body by controlling a position of the power feeding body.

One aspect of the present invention provides a transmission type antenna including: a transmission type structure configured to transmit and radiate an incident radio wave; a power feeding body configured to radiate a radio wave to the transmission type structure or receive the radio wave which is incident on the transmission type structure from an outside and radiated; a first drive unit of which one side is connected to the power feeding body, and is configured to incline the power feeding body by a predetermined angle around the other side as a central axis; a body configured to provide a moving path of the power feeding body; a second drive unit configured to move the power feeding body based on the moving path; and a control unit connected to the first and second drive units and configured to output a control signal to control a moving distance and a tilt angle of the power feeding body.

In the transmission type antenna, the body may have a curved surface corresponding to a part of an elliptical trajectory at an upper part thereof, and a moving path of the power feeding body may be provided along the curved surface.

In the transmission type antenna, an upper part of the body may be a plane, and the power feeding body may move in any direction on the plane of the upper part of the body.

In the transmission type antenna, the first drive unit may incline the power feeding body within a range of −45° to 45°.

In the transmission type antenna, the transmission type structure may include a plurality of phase delay cells configured to change a phase of a radio wave, and a structure surface in which the plurality of phase delay cells are disposed, such that a radio wave, which is incident on each of the plurality of phase delay cells, may may be radiated in a forward direction of the radio wave after changing a phase of the radio wave.

In the transmission type antenna, the transmission type structure may have a structure in which at least two structure surfaces are laminated.

In the transmission type antenna, the structure surface may be a plane.

In the transmission type antenna, the structure surface may be a radome or an insulator.

According to the embodiments of the present invention, a radio wave is transmitted and radiated using a transmission type structure, and a tilting direction of the radio wave of a power feeding body is adjusted by moving the power feeding body, and thus an antenna or a drive shaft can be simplified and lightened.

DETAILED DESCRIPTION

Hereinafter, exemplary embodiments of the present invention will be described in detail with reference to the accompanying drawings. However, these embodiments are only examples and the present invention is not limited thereto.

When the present invention is described, when it is determined that detailed descriptions of known technology related to the present invention unnecessarily obscure the subject matter of the invention, detailed descriptions thereof will be omitted. Some terms described below are defined by considering functions in the invention and meanings may vary depending on, for example, a user or operator's intentions or customs. Therefore, the meanings of terms should be interpreted based on the scope throughout this specification.

The spirit and scope of the present invention are defined by the appended claims. The following embodiments are only made to efficiently describe the technological scope of the invention to those skilled in the art.

Figure 1:
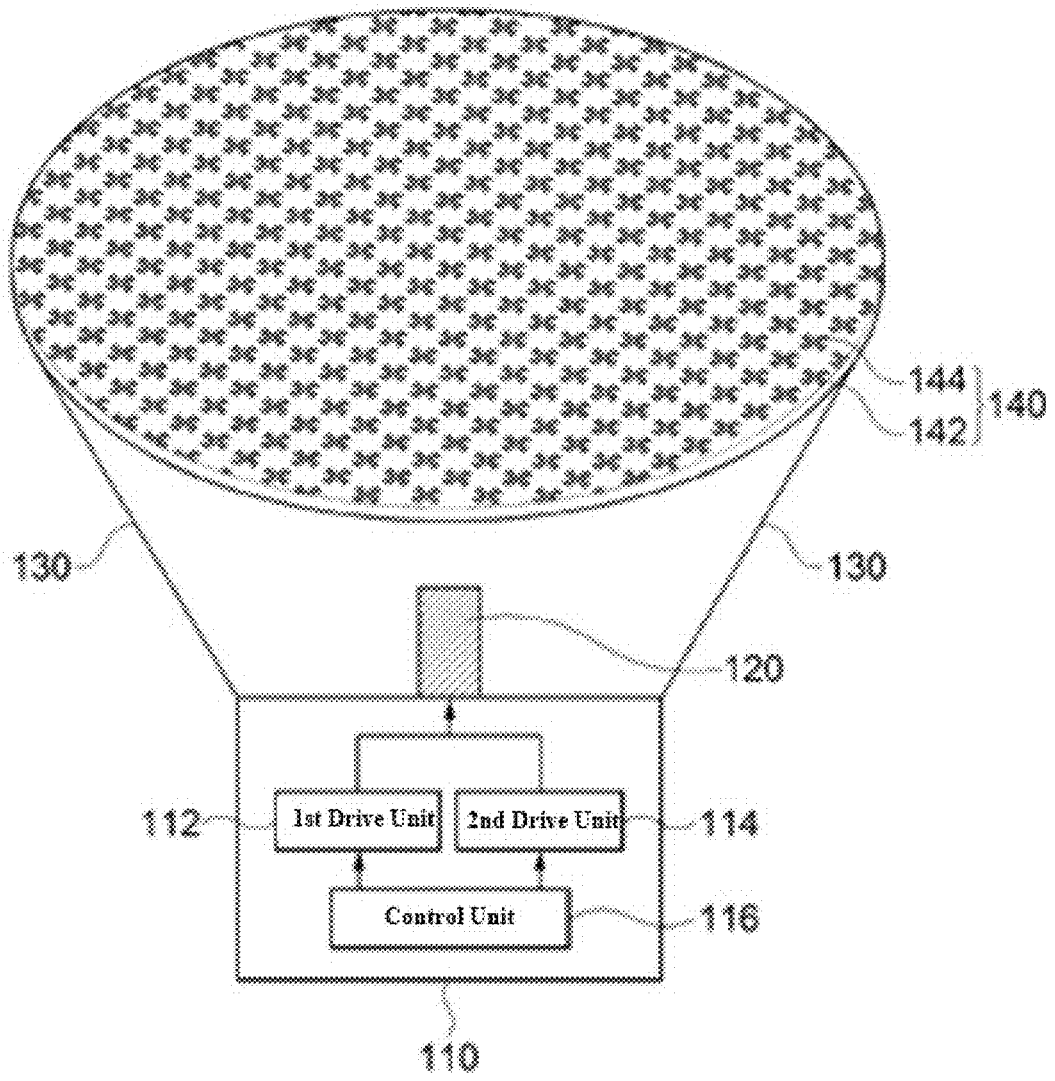
FIG. 1 is a view illustrating a transmission type antenna according to one embodiment of the present invention.

FIG. 1 is a view illustrating a transmission type antenna 100 according to one embodiment of the present invention.

As illustrated in FIG. 1, the transmission type antenna 100 may include a body 110, a power feeding body 120, a plurality of supports 130 and 132, and a transmission type structure 140. The body 110 may include a first drive unit 112, a second drive unit 114, and a control unit 116.

In a predetermined embodiment, the body 110 may be connected and fixed to the transmission type structure 140 through the plurality of supports 130 and 132. Specifically, the body 110 and the transmission type structure 140 may be connected to each other through two supports 130 and 132 connected to both left and right ends of the transmission type structure 140. The body 110 may provide a moving path of the power feeding body 120.

One side of the first drive unit 112 may be connected to the power feeding body 120, and the first drive unit 112 may incline the power feeding body 120 by a predetermined angle around the other side as a central axis. In a predetermined embodiment, a tilt angle of the power feeding body 120 may be within a range of −45° to 45°, but the present invention is not limited thereto.

The second drive unit 114 may move the power feeding body 120 along the moving path provided in the body 110 based on a control of the control unit 116. Specifically, the second drive unit 114 may move the power feeding body 120 in upper, lower, left, right or any direction along an upper surface part of the body 110.

The power feeding body 120 may be connected to one side of the first drive unit 112 and inclined by a predetermined angle around the other side of the first drive unit 112 as the central axis. Accordingly, the power feeding body 120 is not moved on the body 110 but is autonomously moved by the first drive unit 112 such that a tilting direction of a radio wave may be determined.

Further, the tilting direction of the radio wave may be determined by the power feeding body 120 which is moved by the second drive unit 114 in the upper, lower, left, right or any direction, that is, along the moving path provided in the body 110.

Meanwhile, after the power feeding body 120 is inclined by the first drive unit 112, the power feeding body 120 is moved by the second drive unit 114 in the upper, lower, left, and right or any direction, that is, along the moving path provided in the body 110, such that the tilting direction of the radio wave may be determined.

The control unit 116 may be connected to the first drive unit 112 and the second drive unit 114 and output a control signal to control a moving distance and the tilt angle of the power feeding body 120 on the first drive unit 112 and the second drive unit 114. The first drive unit 112 may incline the power feeding body 120 by a predetermined angle based on the control signal, and the second drive unit 114 may move the power feeding body 120 in any direction.

A structure of the body 110 will be described with reference to FIG. 2.

Figure 2:
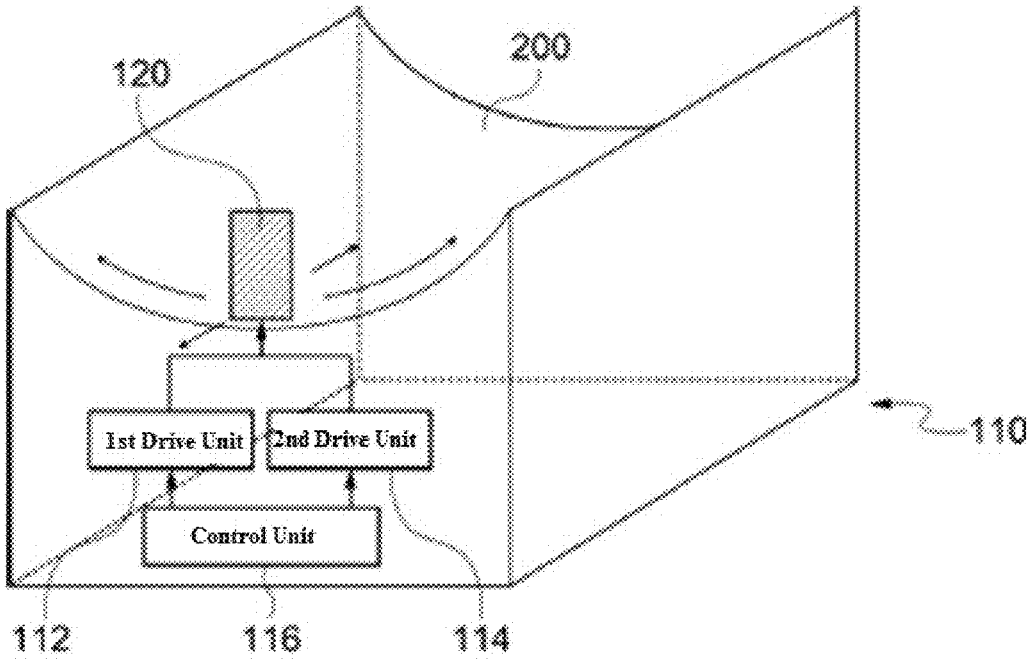
FIG. 2 is an exemplary view showing a structure of a body and a power feeding body according to one embodiment of the present invention.

As illustrated in FIG. 2, the body 110 may have a curved surface 200 at an upper part thereof, and a size of the body 110 may be smaller than a length of a major axis of the transmission type structure 140. The curved surface 200 may be in a partially elliptical shape, but the present invention is not limited thereto.

In a predetermined embodiment, the power feeding body 120 may be connected to the curved surface 200 and moved by the second drive unit 114 along the curved surface 200. Specifically, the power feeding body 120 may be connected to the second drive unit 114 and moved in an elliptical trajectory along the curved surface 200 or in the upper, lower, left, right or any direction.

A movement of the power feeding body 120 based on the second drive unit 114 will be described with reference to FIG. 3.

Figure 3:
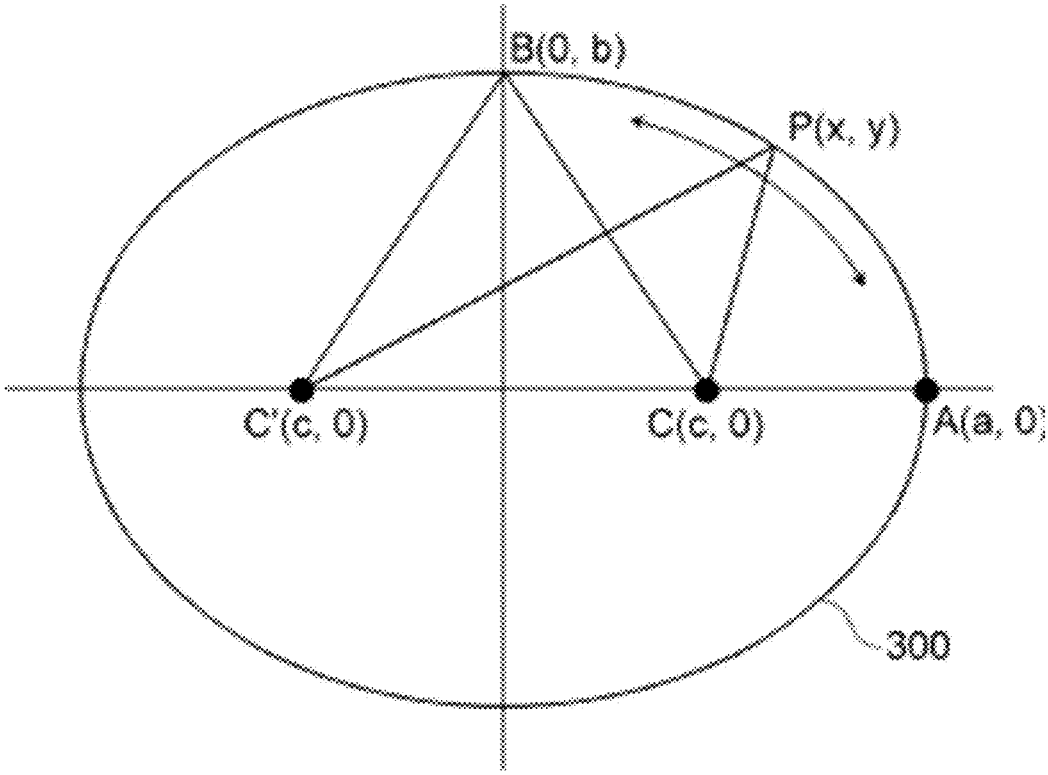
FIG. 3 is a view showing an elliptical trajectory along which the power feeding body moves according to one embodiment of the present invention.

FIG. 3 is a view showing an elliptical trajectory along which the power feeding body 120 moves according to one embodiment of the present invention.

As illustrated in FIG. 3, the power feeding body 120 may be connected to the second drive unit 114 and moved from a point A to a point B, and the point A and the point B may both be endpoints of the curved surface 200.

The power feeding body 120 which is moved between the point A and the point B may radiate a radio wave at a predetermined position, for example, a point P. A point C and a point C' illustrated in FIG. 3 may refer to both ends of the major axis of the transmission type structure 140.

A position of the power feeding body 120 may be determined through the control unit 116, for example, the control unit 116 may determine the position of the power feeding body 120 based on an oval equation such as Equation 1 below.

$$\frac{x^2}{a^2} + \frac{y^2}{b^2} = 1 \qquad \text{[Equation 1]}$$

In Equation 1, a refers to a coordinative value when the power feeding body 120 is positioned at the point A and b refers to a coordinative value when the power feeding body 120 is positioned at the point B. For example, a is a radius of the major axis in an elliptical trajectory 300 along which the power feeding body 120 is moved, and b is a radius of a minor axis in the elliptical trajectory 300 along which the power feeding body 120 is moved. Further, x and y may correspond to tilt positions where the power feeding body 120 radiates a radio wave.

In one embodiment of the present invention, although the power feeding body 120 is described to be moved on the body 110 having the curved surface 200 as an example, the power feeding body 120 may be moved on the body 110 of which an upper part is a plane.

Meanwhile, in one embodiment of the present invention, the transmission type structure 140 is a structure surface 142 having a plurality of phase delay cells 144, and may radiate a radio wave generated in the power feeding body 120 to an outside after changing a phase of the radio wave.

The structure surface 142 may be a structure installed in a forward direction of the radio wave, for example, a radome, an open surface of an antenna, an insulator, etc. Additionally, the structure surface 142 may be implemented by using a substrate having a shape corresponding to the structure.

Further, the structure surface 142 may include the plurality of phase delay cells 144, and a radio wave may be transmitted and provided to the phase delay cells 120 or a radio wave changed in phase by the phase delay cells 144 may be incident on the structure surface 142. Specifically, as a radio wave generated in the power feeding body 120 is incident on the structure surface 142, the radio wave may be transmitted and provided to the phase delay cells 144, and a radio wave incident from the outside may be received to the structure surface 142 through the phase delay cells 120 and provided to the power feeding body 120.

Meanwhile, in one embodiment of the present invention, the structure surface 142 is a plane as an example, but the present invention is not limited thereto.

The plurality of phase delay cells 144 may be formed on a substrate (not illustrated) and arranged in the structure surface 110 or may be arranged in the structure surface 142 in a pattern.

Further, the plurality of phase delay cells 144 may have various patterns, and the phase of the transmitted radio wave may be adjusted according to the shape of the pattern. Specifically, each of the plurality of phase delay cells 144 may adjust the phase of the radio wave radiated to the outside by adjusting a forward speed of the radio wave according to a different pattern and also adjust the phase of the radio wave by adjusting a forward speed of the radio wave incident from the outside. In other words, the forward speed of the radio wave may be adjusted based on the pattern formed in the plurality of phase delay cells 144.

Meanwhile, the pattern of the plurality of phase delay cells 144 may be determined according to a distance that the radio wave reaches. Specifically, in a region of the structure surface 142 which is far from the power feeding body 120, the phase delay cells 144 may form a pattern for increasing a speed of the radio wave, and in a region of the structure surface 142 which is close to the power feeding body 120, the phase delay cells 144 may form a pattern for decreasing the speed of the radio wave. For example, phase delay cells 144 having different patterns may be formed in a central region, an edge region, and a region between the central region and the edge region of the structure surface 142, so that the forward speed of the radio wave may be adjusted.

The pattern in the plurality of phase delay cells 144 may be formed by using a metal material, a meta-material, etc. Here, the meta-material has a structure of which a period is much shorter than a wavelength in order to have a negative permittivity or a negative permeability which does not exist in a material in a natural condition at a certain frequency. For the reason, the meta-material is referred to as a meta-electromagnetic structure or also referred to as an artificial electromagnetic structure because a unique electromagnetic characteristic is implemented due to an artificial structure.

Figure 4:
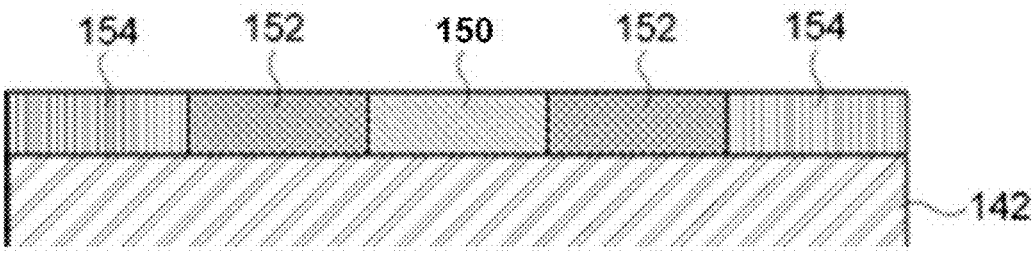
FIG. 4 is a cross-sectional view illustrating a part of a transmission type structure of the transmission type antenna according to one embodiment of the present invention.

Meanwhile, the pattern of the plurality of phase delay cells 144 may be determined according to the distance that the radio wave reaches. Specifically, in a region of the structure surface 142 which is far from the power feeding body 120, the phase delay cells 144 may form a pattern for increasing the speed of the radio wave, and in a region of the structure surface 142 which is close to the power feeding body 120, the phase delay cells 144 may form a pattern for decreasing the speed of the radio wave. For example, as illustrated in FIG. 4, the phase delay cells 144 having different patterns may be formed in a central region 150, an edge region 154, and a region 152 between the central region 150 and the edge region 154 of the structure surface 142 so that the forward speed of the radio wave may be adjusted.

Meanwhile, in one embodiment of the present invention, the transmission type structure 140 is described as a single-layer structure, that is, a single-layer structure made of the structure surface 142 in which the plurality of phase delay cells 144 are formed, as an example, but the transmission type structure 140 may also have a structure in which a plurality of structure surfaces 142 are laminated.

While the present invention has been described above in detail with reference to representative embodiments, it should be understood by those skilled in the art that the embodiment may be variously modified without departing from the scope of the present invention. Therefore, the scope of the present invention is defined not by the described embodiment but by the appended claims, and encompasses equivalents that fall within the scope of the appended claims.

The invention claimed is:

1. A transmission type antenna comprising:

a transmission type structure configured to transmit and radiate an incident radio wave;

a plurality of supports;

a body having an upper surface, the body connected to the transmission type structure through the plurality of supports;

a power feeding body configured to radiate a radio wave to the transmission type structure or receive a radiated radio wave which is incident on the transmission type structure from an outside, the power feeding body moving on the upper surface of the body providing a moving path for the power feeding body;

a first drive unit of which one side is connected to the power feeding body, and is configured to incline the power feeding body by a predetermined angle around the other side as a central axis;

a second drive unit configured to move the power feeding body on the upper surface of the body; and a control unit connected to the first and second drive units and configured to output a control signal to control a moving distance and a tilt angle of the power feeding body.

2. The transmission type antenna of claim 1, wherein the upper surface of the body has a curved surface corresponding to a part of an elliptical trajectory at an upper part thereof, and the moving path of the power feeding body is provided along the curved surface.

3. The transmission type antenna of claim 1, wherein an upper surface of the body is a plane, and the power feeding body moves in any direction on the plane of the upper part of the body.

4. The transmission type antenna of claim 1, wherein the first drive unit inclines the power feeding body within a range of −45° to 45°.

5. The transmission type antenna of claim 1, wherein the transmission type structure comprises:

a plurality of phase delay cells configured to change a phase of a radio wave; and a structure surface in which the plurality of phase delay cells are disposed, wherein a phase of a radio wave which is incident on each of the plurality of phase delay cells is changed, and the radio wave is radiated in a forward direction of the radio wave.

6. The transmission type antenna of claim 5, wherein the transmission type structure has a structure in which at least two structure surfaces are laminated.

7. The transmission type antenna of claim 5, wherein the structure surface is a plane.

8. The transmission type antenna of claim 5, wherein the structure surface is a radome or an insulator.

9. The transmission type antenna of claim 5, wherein the first drive unit inclines only the power feeding body.

* * * * *